US010544492B2

(12) United States Patent
Shishido et al.

(10) Patent No.: US 10,544,492 B2
(45) Date of Patent: Jan. 28, 2020

(54) ALUMINUM ALLOY SHEET WITH EXCELLENT BAKING PAINT HARDENABILITY

(71) Applicant: Kobe Steel, Ltd., Kobe-shi (JP)

(72) Inventors: Hisao Shishido, Kobe (JP); Katsushi Matsumoto, Kobe (JP); Yasuhiro Aruga, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 737 days.

(21) Appl. No.: 14/762,737

(22) PCT Filed: Feb. 10, 2014

(86) PCT No.: PCT/JP2014/053105
§ 371 (c)(1),
(2) Date: Jul. 22, 2015

(87) PCT Pub. No.: WO2014/126073
PCT Pub. Date: Aug. 21, 2014

(65) Prior Publication Data

US 2015/0354044 A1 Dec. 10, 2015

(30) Foreign Application Priority Data

Feb. 13, 2013 (JP) ..... 2013-025619

(51) Int. Cl.

| | |
|---|---|
| ***C22F 1/047*** | (2006.01) |
| ***C22F 1/043*** | (2006.01) |
| ***C22F 1/00*** | (2006.01) |
| ***C22C 21/02*** | (2006.01) |
| ***C22C 21/08*** | (2006.01) |

(52) U.S. Cl.
CPC ..... *C22F 1/047* (2013.01); *C22C 21/02* (2013.01); *C22C 21/08* (2013.01); *C22F 1/002* (2013.01); *C22F 1/043* (2013.01)

(58) Field of Classification Search
CPC ..... C22C 21/02; C22C 21/08; C22F 1/047; C22F 1/002; C22F 1/043
See application file for complete search history.

(56) References Cited

U.S. PATENT DOCUMENTS

2014/0003993 A1* 1/2014 Matsumoto et al. ..... 420/534

FOREIGN PATENT DOCUMENTS

| | | |
|---|---|---|
| JP | 8 81744 | 3/1996 |
| JP | 2006 9140 | 1/2006 |
| JP | 2012 41567 | 3/2012 |
| WO | 2012 124676 | 9/2012 |

OTHER PUBLICATIONS

Machine translation of JP 2012041567, 2012.*
International Search Report and Written Opinion of the International Searching Authority dated Apr. 8, 2014 in PCT/JP2014/053105 Filed Feb. 10, 2014.

* cited by examiner

*Primary Examiner* — Colleen P Dunn
*Assistant Examiner* — Anthony M Liang
(74) *Attorney, Agent, or Firm* — Oblon, McClelland, Maier & Neustadt, L.L.P.

(57) ABSTRACT

The aluminum alloy sheet of the present invention is a specific 6000-series aluminum alloy sheet in which the total sum (total amount) of Mg and Si existing in specific aggregates of atoms (clusters) is regulated and the total sum of Mg and Si existing in the aggregates of atoms is ensured so as to be balanced with the total amount of Mg and Si solid-solutionized in the matrix, and thus BH response (bake hardenability) after natural aging at room temperature and proof strength after BH treatment (bake hardening treatment) are further improved.

10 Claims, No Drawings

ALUMINUM ALLOY SHEET WITH EXCELLENT BAKING PAINT HARDENABILITY

TECHNICAL FIELD

The present invention relates to an Al—Mg—Si alloy sheet. The aluminum alloy sheet referred to in the present invention means an aluminum alloy sheet, which is a rolled sheet such as a hot rolled sheet and a cold rolled sheet, after being subjected to refining such as solution heat treatment and quenching treatment and before being subjected to baking paint hardening treatment. Aluminum is also referred to as Al in the following description.

BACKGROUND ART

In recent years, the social demands for weight saving of vehicles such as automobiles and the like have been increasing more and more due to consideration for global environment and the like. In order to respond to such requirement, as materials for automotive panels, in particular large body panels (outer panels and the inner panels) such as hoods, doors, and roofs, application of aluminum alloy materials having excellent formability and baking paint hardenability and lighter weight has been increasing, instead of steel materials such as steel sheets.

Among them, use of Al—Mg—Si-based AA or JIS 6000-series (hereinafter, also simply referred to as 6000-series) aluminum alloy sheet is studied as a thin-walled high strength aluminum alloy sheet for automobile panels of outer panels (outer sheets) and inner panels (inner sheets) of panel structures such as hoods, fenders, doors, roofs, and trunk lids.

The 6000-series aluminum alloy sheet essentially contains Si and Mg. Particularly, the excessive Si type 6000-series aluminum alloy has a composition in which Si/Mg is 1 or more in a mass ratio and has excellent aging hardenability. Therefore, the 6000-series aluminum alloy ensures formability at the time of press forming and bending processing based on low proof strength and has baking paint hardenability (hereinafter, also referred to as bake hardening properties=BH response and bake hardenability) that ensures required strength as panels because the proof strength is improved by aging hardening caused by heating at the time of artificial aging (hardening) treatment such as paint baking treatment of the panels after the forming.

The 6000-series aluminum alloy sheet has a relatively low alloy element amount compared with other aluminum alloys such as a 5000-series aluminum alloy having a large alloy amount such as a Mg amount. Therefore, when the scrap of the 6000-series aluminum alloy sheet is reused as an aluminum alloy melting material (melting raw material), the original 6000-series aluminum alloy ingots are easily obtained, and therefore the 6000-series aluminum alloy also has excellent recyclability.

However, even such a 6000-series aluminum alloy sheet has insufficient strength level after BH and thus further strength improvement is required for achieving lighter weight due to a thin wall thickness. In other words, when the 6000-series aluminum alloy sheets are used for pillars such as a center pillar, arms such as a side arm, or reinforcing members such as a bumper reinforcement and door beam, which are skeletal members or structural members, in a state of thin sheets, the strength after BH is insufficient. This problem also arises when the 6000-series aluminum alloy sheets are used for skeletal members or structural members other than the automotive use as the thin sheets.

Conventionally, various suggestions have been made for improving the BH response of the 6000-series aluminum alloy. For example, Patent Literature 1 suggests that strength change at room temperature after production be suppressed by changing a cooling rate stepwise at the time of the solution heat treatment and the quenching treatment to obtain the BH response. Patent Literature 2 suggests that the BH response and a shape fixability be obtained by, holding the aluminum alloy at a temperature of 50° C. to 150° C. for 10 minutes to 300 minutes within 60 minutes after the solution heat treatment and the quenching treatment. Patent Literature 3 suggests that the BH response and the shape fixability be obtained by regulating the cooling temperature at the first step and the cooling rate thereafter at the time of the solution heat treatment and the quenching treatment.

Patent Literature 4 suggests that the BH response be improved by heat treatment after solution hardening. Patent Literature 5 suggests that the BH response be improved in accordance with regulation by an endothermic peak measured with a DSC (Differential scanning calorimetry) method. Similar to Patent Literature 5, Patent Literature 6 suggests that the BH response be improved in accordance with regulation by an exothermic peak measured with DSC. However, for the cluster (aggregate of atoms) that directly affects the BH response of the 6000-series aluminum alloy sheet, these Patent Literatures 1 to 6 merely indirectly analogize the behavior of the cluster.

On the other hand, in Patent Literature 7, the cluster (the aggregates of atoms) that directly affects the BH response of the 6000-series aluminum alloy sheet is tried to be directly measured and regulated. More specifically, among the clusters (aggregates of atoms) observed by analyzing the microstructures of the 6000-series aluminum alloy sheet with a transmission electron microscope having a magnification of one million, an average number density of the clusters having a circle-equivalent diameter in a range of 1 nm to 5 nm is regulated in a range of 4000 clusters/$\mu m^2$ to 30000 clusters/$\mu m^2$ to obtain the 6000-series aluminum alloy sheet having excellent BH response and suppressing the natural aging at room temperature.

In Patent Literature 8, it has been found out that the cluster to which Mg atoms and Si atoms have a specific relation is correlated with the BH response by directly measuring the cluster that is significantly affected with the BH response by 3DAP described below. In addition, it has been found out that high BH response can be achieved by increasing the number density of the aggregates of atoms that satisfy these conditions even when automobile body paint baking treatment is carried out after the natural aging at room temperature.

CITATION LIST

Patent Literature

Patent Literature 1: Japanese Unexamined Patent Application Publication No. 2000-160310

Patent Literature 2: Japanese Patent No. 3207413

Patent Literature 3: Japanese Patent No. 2614686

Patent Literature 4: Japanese Unexamined Patent Application Publication No. H4-210456

Patent Literature 5: Japanese Unexamined Patent Application Publication No. H10-219382

Patent Literature 6: Japanese Unexamined Patent Application Publication No. 2005-139537

Patent Literature 7: Japanese Unexamined Patent Application Publication No. 2009-242904

Patent Literature 8: Japanese Unexamined Patent Application Publication No. 2012-193399

SUMMARY OF INVENTION

Technical Problem

However, even Patent Literatures 7 and 8 provide a proof strength after baking paint of merely less than about 230 MPa and thus the BH response and the strength after BH are insufficient in a state where thinning of the aluminum alloy sheet is required.

This is also because these conventional techniques indirectly presume the behavior of the aggregates of atoms (clusters) through properties and DSC measurements or these conventional techniques have only controlled the size and the number density of the relatively large aggregates of atoms evaluated by TEM observation. In other words, this is also because these conventional techniques cannot evaluate the aggregates of atoms in detail and thus fine control of the aggregates of atoms is insufficient.

The present invention has been made in the view of such problems, and the purpose of the present invention is to provide the 6000-series aluminum alloy sheet that can achieve high BH response even for the automobile body paint baking treatment after the natural aging at room temperature by evaluating the aggregates of atoms in microstructures in more detail.

Solution to Problem

In order to achieve this purpose, the gist of the aluminum alloy sheet having excellent baking paint hardenability of the present invention is an Al—Mg—Si alloy sheet comprising Mg of 0.2% to 2.0% and Si of 0.3% to 2.0% in % by mass with a remainder comprising of Al and inevitable impurities, wherein a ratio of $N_{cluster}$ to $N_{total}$, $(N_{cluster}/N_{total})\times100$, is 10% or more and 30% or less, where a sum of the number of all Mg atoms and Si atoms measured by a three-dimensional atom probe field ion microscope is defined as $N_{total}$, and a sum of the number of all Mg atoms and Si atoms contained in all aggregates of atoms that satisfy conditions in which the aggregate of atoms measured by the three-dimensional atom probe field ion microscope contains either of Mg atoms or Si atoms or both of Mg atoms and Si atoms by 10 or more atoms in total and, when any atom of the Mg atoms or the Si atoms contained in the aggregate of atoms is determined to be a reference, a distance between the reference atom and any one of other adjacent atoms is 0.75 nm or less is defined as $N_{cluster}$.

Advantageous Effects of Invention

In the present invention, the BH response is improved by intentionally improving the strength before the baking paint. On the other hand, in the conventional techniques, the strength increase (BH response) during the baking paint is improved with intentionally lowering the strength before the baking paint in order to ensure press formability of the raw material sheet into automotive panels before the baking paint.

However, such low strength before the baking paint obviously results in limitation and restriction of the strength increase (BH response) during the baking paint. Therefore, the proof strength after BH is at most less than about 230 MPa and thus the BH response, that is, the strength after BH have been insufficient to use for the skeletal members or structural members of automobiles or applications other than automobiles in a state where thinning of the aluminum alloy sheet is required.

On the other hand, the BH response deteriorates when the natural aging at room temperature is carried out in order to improve the strength before the baking paint and thus the strength (BH response) after the baking paint cannot be improved. This results in contradiction.

In order to solve this contradiction and to improve the BH response with increasing the strength before the baking paint, in the present invention, the total sum (total amount) of Mg and Si existing in the aggregates of atoms (the clusters) as regulated above is controlled. More specifically, the BH response can be improved with improving the strength before the baking paint by ensuring the total sum of Mg and Si in the aggregates of atoms (the clusters) regulated as described above so as to be balanced with the total amount of Mg and Si solid-solutionized in the matrix.

In addition to the aspects of the aggregates of atoms regulated in the present invention or the solid solution in the matrix, Mg and Si contained in the 6000-series aluminum alloy sheet may exist as aggregates of atoms coarser than the regulated size or in a state of being included in further coarser precipitates or intermetallic compounds. On the other hand, control of the total amount of Mg and Si in the aggregates of atoms (clusters) regulated as described above so as to be balanced with the total amount of Mg and Si solid-solutionized in the matrix may also lead to reduction in the coarse aggregates of atoms due to Mg and Si or the further coarser precipitates or intermetallic compounds themselves.

In the present invention, because of these combined effects, the 6000-series aluminum alloy sheet achieving higher BH response can be provided even when the strength before the baking paint is increased.

DESCRIPTION OF EMBODIMENTS

Hereinafter, each requirement of the embodiment of the present invention will be specifically described.

Cluster (Aggregate of Atoms):

First, the meaning of the cluster referred in the present invention will be described. The cluster described in the present invention refers to an aggregate of atoms (cluster) measured by the 3DAP described below and is mainly represented as the cluster in the following description. For the 6000-series aluminum alloy, it has been known that Mg and Si form aggregates of atoms referred to as clusters during holding at room temperature or heat treatment at 50° C. to 150° C. after the solution heat treatment and the quenching treatment. However, the clusters generated during the holding at room temperature and the clusters generated during the heat treatment at 50° C. to 150° C. have completely different behaviors (properties).

The cluster formed during the holding at room temperature suppresses formation of a GP zone or a β' phase that increases the strength in the artificial aging or baking paint treatment carried out later. On the contrary, it is described that the cluster (or Mg/Si cluster) formed during the heat treatment at 50° C. to 150° C. promotes formation of the GP zone or the 13' phase (For example, described in Yamada et al. Keikinzoku (Light Metal) vol. 51, p. 215).

Paragraphs 0021 to 0025 in Patent Literature 7 describe that these clusters have been conventionally analyzed by specific heat measurement, the 3DAP (three-dimensional atom probe), or the like. At the same time, although the existence of the cluster itself is supported by the observation in the analysis of the cluster with the 3DAP, the size and the number density of the cluster regulated in the present invention are unclear or are measured only in a limited way.

Surely, an attempt has been made to analyze the cluster in the 6000-series aluminum alloy with the 3DAP (the three-dimensional atom probe). However, as described in Patent Literature 7, although the existence of the cluster itself is supported, the size and the number density of the cluster are unclear. This is because which clusters in the aggregates of atoms (clusters) measured with the 3DAP are strongly correlated with the BH response is unclear and which aggregates of atoms are strongly related to the BH response is unclear.

On the contrary, the inventors of the present invention clarify the cluster strongly related to the BH response in Patent Literature 8. More specifically, the inventors of the present invention have found out that, among the clusters measured with the 3DAP, the specific clusters in which the specific total amount of Mg atoms and/or Si atoms are contained in accordance with the regulation described above and the distance between the adjacent atoms contained in the clusters is the specific distance or less are strongly correlated with the BH response. The inventors of the present invention also have found out that high BH response can be achieved by increasing the number density of the aggregates of atoms satisfying these conditions even when the automobile body paint baking treatment is carried out after the natural aging at room temperature.

Specifically, in Patent Literature 8, an Al—Mg—Si alloy sheet having excellent baking paint hardenability comprising Mg of 0.2% to 2.0% and Si of 0.3% to 2.0% in mass % with the remainder comprising Al and inevitable impurities, wherein an aggregate of atoms measured by a three-dimensional atom probe field ion microscope contains either of Mg atoms or Si atoms or both of Mg atoms and Si atoms by 30 or more atoms in total and, when any atom of the Mg atoms or the Si atoms contained in the aggregate of atoms is determined to be a reference, the distance between the reference atom and any one of other adjacent atoms is 0.75 nm or less, and the aggregates of atoms satisfying these conditions are contained by an average number density of $1.0\times10^5$ aggregates/$\mu m^3$ or more is applied.

According to Patent Literature 8, existence of the clusters in which either of Mg atoms or Si atoms or both of Mg atoms and Si atoms by 30 or more atoms in total are contained and the distance between the adjacent atoms is 0.75 nm or less improves the BH response. Patent Literature 8 described that the existence of these clusters in a certain amount or more allows higher BH response to be achieved even when the automobile body paint baking treatment of the natural aged Al—Mg—Si alloy sheet is carried out at a low temperature of 150° C. for a short period of time of 20 minutes.

On the other hand, the inventors of the present invention have found out that existence of the large number of the clusters among clusters measured with the 3DAP surely results in improving the BH response. However, the existence of the large number of the clusters alone results in insufficient improving effect. In other words, the inventors of the present invention have found out that the existence of the large number of the clusters is a prior condition (required condition) for improving the BH response, but is not necessarily a sufficient condition.

Therefore, the inventors of the present invention have filed Japanese Patent Application No. 2011-199769 (filed on Sep. 13, 2011). More specifically, on the assumption that the aggregates of atoms satisfying the specific conditions described above are included in an average number density of $6.0\times10^{23}$ aggregates/$m^3$ or more, among the aggregates of atoms satisfying these conditions, the average number density of aggregates of atoms having a size of a maximum circle-equivalent radius of less than 1.5 nm is regulated to $10.0\times10^{23}$ aggregates/$m^3$ and aggregates of atoms having the size of a maximum circle-equivalent radius of 1.5 nm or more are contained so that a ratio of a/b is 3.5 or less, where the average number density a is an average number density of the aggregates of atoms having a size of a maximum circle-equivalent radius of less than 1.5 nm and the average number density b is an average number density of the aggregates of atoms having a size of a maximum circle-equivalent radius of 1.5 nm or more.

This application is based on the consideration that the clusters containing either of Mg atom or Si atom or both of Mg atom and Si atom naturally have difference (distribution) in their sizes (largeness) and action to the BH response largely depends on the size of the cluster. The action to the BH response depending on the largeness of the cluster has the following opposite difference. The cluster having relatively small size impedes the BH response, whereas the cluster having relatively large size promotes the BH response. Based on this finding, the BH response is improved more by decreasing the amount of the cluster having relatively small size and increasing the amount of the cluster having relatively large size. It is inferred that although the cluster having relatively small size is disappeared at the time of BH treatment (at the time of artificial aging hardening treatment), this has the opposite effect of impeding the formation of the large cluster having large effect for improving the strength at the time of BH treatment and thus the BH response deteriorates. On the other hand, it is inferred that the cluster having relatively large size grows at the time of the BT treatment to promote the formation of the precipitate at the time of the BH treatment and thus the BH response is improved.

In the subsequent study, however, the inventors of the present invention also have found out that, even this cluster having a relatively large size, an excessively large cluster becomes too large in size when the cluster grows at the time of the BH treatment and thus the BH response deteriorates, and at the same time, the strength before the BH treatment becomes excessively high and thus processability deteriorates. Consequently, the cluster having an optimum size exists in order to improve the BH response without deterioration of the processability. The distribution state of the sizes of the specific aggregates of atoms is important. However, the inventors of the present invention have found out that the average radius of the circle-equivalent diameter that is an average size of the specific aggregates of atoms and a standard deviation of the average radius of the equivalent diameter largely affect the BH response. The inventors of the present invention have filed this content as Japanese Patent Application No. 2012-051821 (filed on Mar. 8, 2012). In Japanese Patent Application No. 2012-051821, the average radius of the circle-equivalent diameter of the cluster is determined to be 1.2 nm or more and 1.5 nm or less and the standard deviation of the radii of the circle-equivalent diameters is determined to be 0.35 nm, and thus only the clusters having the optimum size are generated.

In the further subsequent study, the inventors of the present invention have found out that the balance between the aggregates of atoms (clusters) and the amounts of the solid-solutionized Mg and Si significantly affect BH response and the strength after the BH treatment and have accomplished the present invention. More specifically, the present invention is based on the finding that the BH response can be improved while improving the strength before the baking paint by controlling the ratio of Mg atoms and Si atoms contained in the aggregates of atoms satisfying the regulation conditions and Mg and Si existing in the matrix.

(Regulation of Cluster of the Present Invention)

Hereinafter, the regulation of the cluster presuming the present invention will be specifically described.

As described above, the aluminum alloy sheet of the present invention that regulates the cluster is an aluminum alloy sheet that is the rolled sheet such as the hot rolled sheet and the cold rolled sheet, after being subjected to refining such as solution heat treatment and quenching treatment and before being subjected to baking paint hardening treatment. In order to form the sheet as the automobile members, the sheet is often left at room temperature for a relatively long period of time of about 0.5 to 4 months. Therefore, even in the state of the microstructure of the sheet after being left at room temperature for the relatively long period of time, this microstructure is preferably the microstructure regulated by the present invention. From this viewpoint, when the properties after long period of lapse at room temperature is regarded as a problem, the microstructure and the properties of the sheet that is left to stand for 100 days or more after the lapse at room temperature of the sheet sufficiently proceeds and the sheet is subjected to a series of the refining are more preferably investigated and evaluated because the properties may not be changed for a lapse at room temperature for about 100 days and the microstructure may also not be changed.

(Definition of Cluster of the Present Invention)

The microstructure in any center parts in the thickness direction of such an aluminum alloy sheet is measured with a three-dimensional atom probe field ion microscope. In the present invention, the cluster existing in the measured microstructure, first, the cluster contains either of Mg atoms or Si atoms or both of Mg atoms and Si atoms by 10 or more atoms in total. The number of the Mg atoms and the Si atoms contained in the aggregate of atoms is preferably as many as possible, and the upper limit thereof is not particularly regulated. From the production limit, however, the upper limit of the number of the Mg atoms and the Si atoms contained in the cluster is approximately 10,000 atoms.

In Patent Literature 8, the cluster is determined to contain either of Mg atoms or Si atoms or both of Mg atoms and Si atoms by 30 or more atoms. In the present invention, however, the cluster having relatively small size is regulated so that the number of the clusters having relatively small size is decreased because the cluster having relatively small size impedes the BH response as described above. Therefore, in order to control this cluster having relatively small size that should be regulated in a measurable range, the cluster is regulated to contain either of Mg atoms or Si atoms or both of Mg atoms and Si atoms by 10 or more atoms in total.

In addition, in the present invention, the cluster in which, when any atom of the Mg atoms or the Si atoms contained in the aggregate of atoms is determined to be a reference, the distance between the reference atom and any one of other adjacent atoms is 0.75 nm or less is determined to be the aggregate of atoms (cluster) that is regulated in the present invention (that satisfies the regulation of the present invention) as similar to Patent Literature 8. This distance 0.75 nm therebetween is a figure determined in order to assure the number density of the clusters having relatively large size in which the distance between atoms of Mg and Si is short and that has the BH response improvement effect after the natural aging at room temperature, whereas in order to regulate the cluster having a relatively small size and to control number density in a low density. Until now, the inventors of the present invention have investigated in detail the relation between the aluminum alloy sheet that can achieve high BH response in the automobile body paint baking treatment and the aggregates of an atomic level. As a result, the inventors of the present invention experimentally found out that the high number density of the aggregates of atoms regulated by the definition described above represents the form of the microstructure achieving the high BH response. Therefore, although the technical implication of the distance between atoms of 0.75 nm has not been sufficiently clarified, this distance is necessary for strictly assuring the number density of the aggregates of atoms which achieves the high BH response and is a figure determined for that purpose.

In the cluster regulated in the present invention, although the case that both of Mg atoms and Si atoms are contained is most frequently seen, the case that Mg atoms are contained but Si atoms are not contained and the case that Si atoms are contained but Mg atoms are not contained are also included. The cluster is not always constituted of only Mg atoms and Si atoms, and Al atoms are contained with very high probability in addition to them.

Depending on the component composition of the aluminum alloy sheet, the case that alloy elements and atoms such as Fe, Mn, Cu, Cr, Zr, V, Ti, Zn or Ag being contained as impurities are contained in the cluster and these other atoms are counted by the 3DAP analysis inevitably occurs. However, even when these other atoms (originated from the alloy elements and impurities) may be contained in the cluster, these other atoms are contained in a less level compared to the total number of atoms of the Mg atoms and the Si atoms. Therefore, even when such other atoms are contained in the clusters, the clusters satisfying the regulation (condition) function as the clusters of the present invention similar to the clusters formed of only Mg atoms and Si atoms. Consequently, the cluster regulated in the present invention may contain any other atoms as long as the cluster satisfies the regulation described above.

The clause "when any atom of the Mg atoms or the Si atoms contained in the aggregate of atoms is determined to be a reference, the distance between the reference atom and any one of other adjacent atoms is 0.75 nm or less" of the present invention means that all of the Mg atoms and the Si atoms existing in the cluster have at least one Mg atom or Si atom having the distance therebetween of 0.75 nm or less at the periphery thereof.

For the regulation of the distance between atoms in the cluster of the present invention, when any atom of the Mg atoms or the Si atoms contained in the cluster is determined to be a reference, all of the distances between the reference atom and all atoms among the other adjacent atoms are not necessarily 0.75 nm or less, and, contrarily, all of the distances may be 0.75 nm or less. In other words, other Mg atom or Si atom whose distance exceeds 0.75 nm may be adjacent, and at least one atom of other Mg atoms or Si atoms satisfying the regulated distance (space) may exist around the specific Mg atom or Si atom (Mg atom or Si atom of the reference).

When one atom of other adjacent Mg atoms or Si atoms that satisfies this regulated distance exists, the number of atoms of the Mg atoms or Si atoms that should be counted satisfying the condition of the distance becomes two atoms including the specific Mg atom or Si atom (Mg atom or Si atom of the reference). When two atoms of other adjacent Mg atoms or Si atoms that satisfy the regulated distance exist, the number of atoms of the Mg atoms or Si atoms that should be counted satisfying the condition of the distance becomes three atoms including the specific Mg atom or Si atom (Mg atom or Si atom of the reference).

The cluster described above is a cluster formed by reheating treatment after the solution heat treatment and the quenching treatment in the refining after the rolling described above and described below in detail. More specifically, the cluster in the present invention is the aggregate of atoms generated by reheating treatment after the solution heat treatment and the quenching treatment, and is a cluster in which either of Mg atoms or Si atoms or both of Mg atoms and Si atoms are contained by 10 or more atoms in total and, when any atom of the Mg atoms or the Si atoms contained in the cluster is determined to be a reference, a distance between the reference atom and any one of other adjacent atoms is 0.75 nm or less.

(Amounts of Mg and Si in Cluster)

In the present invention, the total sum of the Mg and Si atoms existing in all clusters, which are defined as described above (satisfy the precondition), contained in an entire aluminum alloy sheet is controlled in relation with the total amount of Mg and Si contained in the entire aluminum alloy sheet. This results in appropriately controlling the balance between the total sum of the atoms of Mg and Si existing in the cluster as defined above and the total amount of the atoms of Mg and Si solid-solutionized in the matrix of the aluminum alloy sheet. This allows the BH response to be improved while improving the strength of the baking paint.

In order to control the balance, on the assumption that the cluster are measured with a three-dimensional atom probe field ion microscope in the present invention, $N_{cluster}$, which is the sum (total sum) of the number of all Mg and Si atoms contained in the measured specific cluster (aggregate of atoms), is determined to have a constant ratio to $N_{total}$, which is the sum (total sum) of the number of all Mg and Si atoms measured.

In other words, the ratio of $N_{cluster}$ to $N_{total}$, $(N_{cluster}/N_{total})\times100$, is determined in a range of 10% or more and 30% or less. Here, the ratio of $N_{cluster}$ to $N_{total}$ calculated in accordance with $(N_{cluster}/N_{total})\times100$ is an average (average ratio) in a plurality of measurement positions in the center part in the sheet thickness direction of the sample sheet as Example described below.

By providing such a balanced microstructure, the sheet having a strength after the baking paint of 220 MPa or more and BH response (deference in strength before and after the baking paint treatment) of more than 90 MPa, preferably a strength after the baking paint of 250 MPa or more and BH response of more than 90 MPa, and more preferably a strength after the baking paint of 280 MPa or more and BH response of more than 100 MPa can be achieved after the sheet is held at room temperature (is left to stand at room temperature) for 100 days after production.

The fact of such a correlation between the microstructure and the BH response, however, has been experimentally found out and thus the mechanism of the correlation has not been sufficiently clarified yet. When the average ratio $(N_{cluster}/N_{total})\times100$ of $N_{cluster}$ to $N_{total}$ described above is less than 10%, however, Mg and Si solid-solutionized in the aluminum alloy sheet are increased. As a result, the precipitate formation caused by the cluster is less strengthened and thus the strength before the baking paint deteriorates due to limitation of strengthening of solid solution. Therefore, the strength after the baking paint inevitably tends to deteriorate.

On the other hand, when the average ratio $(N_{cluster}/N_{total})\times100$ of $N_{cluster}$ to $N_{total}$ described above is more than 30%, the amounts of Mg and Si contained in the cluster is excessively large and thus the amounts of Mg and Si solid-solutionized in the aluminum alloy sheet is decreased. Therefore, the number of reinforcing phase (β") generated at the time of artificial aging hardening is decreased and thus the BH response tends to deteriorate. Consequently, the strength after the baking paint also tends to deteriorate.

(Cluster Density)

In order to control the average ratio $(N_{cluster}/N_{total})\times100$ of $N_{cluster}$ to $N_{total}$ described above in the range of 10% to 30%, the clusters regulated in the present invention is preferably contained in an average number density of $1.0\times10^{24}$ clusters/$m^3$ or more. The average number density of the clusters is excessively lower than $1.0\times10^{24}$ clusters/$m^3$, 10% or more of the total sum of Mg and Si existing in the clusters described above is difficult to be achieved. The upper limit of the average number density of the cluster is determined by the production limit of the cluster and is about $25.0\times10^{24}$ clusters/$m^3$ (about $2.5\times10^{25}$ clusters/$m^3$).

(Measurement Principle and Measurement Method of 3DAP)

The 3DAP (three-dimensional atom probe) is a field ion microscope (FIM) attached with a time-of-flight mass spectrometer. The 3DAP is a local analyzer that can observe individual atoms on the metal surface by the field ion microscope and can identify these atoms by the time-of-flight mass spectrometry by the constitution described above. The 3DAP is a significantly effective means for microstructural analysis of the aggregates of atoms because the 3DAP can simultaneously analyze the kind and position of atoms emitted from the sample. Therefore, as described above, the 3DAP is used for analysis of the microstructure of a magnetic recording film, an electronic device, steel, or the like as a known technique. Recently, the 3DAP also has been used for determination of the cluster of the microstructure of an aluminum alloy sheet and the like as described above.

The 3DAP utilizes an ionizing phenomenon of sample atoms themselves under a high electric field that is called electric field evaporation. When high voltage required for the electric field evaporation of the sample atoms is applied to the sample, the atoms are ionized from the sample surface, pass through a probe hole, and reach a detector. This detector is a position sensitive detector, carries out mass spectroscopy of individual ions (identification of elements being atomic species), measures the time of flight until each ion reaches the detector, and whereby can simultaneously determine the detected position (atomic structural position). Consequently, the 3DAP can simultaneously measure the position and the atomic species of the atoms at the apex of the sample, and thus has the feature that the atomic structure of the apex of the sample can be three-dimensionally reconstituted and observed. Distribution in the depth direction of the atoms from the apical surface of the sample can be examined with the resolution of an atomic level because the electric field evaporation occurs in order from the apical surface of the sample.

The sample to be analyzed is required to have high electro-conductivity such as metals because the 3DAP utilizes a high electric field. In addition, the shape of the sample is generally required to be an ultrafine needle shape having an apex diameter of around 100 nm or less. Therefore, a sample is collected from the center part in the sheet thickness direction and the like of an aluminum alloy sheet that is determined as an object to be measured. The sample is cut and electropolished with a precise cutting device to prepare the sample having an ultrafine needle shape apical part for analysis. Examples of the measurement method include a method for applying high pulse voltage of 1 kV order to the aluminum alloy sheet sample whose apex is formed into a needle shape by using "LEAP 3000" manufactured by Imago Scientific Instruments Corporation and continuously ionizing several million atoms from the apex of the sample. Mass spectroscopy of the ions (identification of the element being the atomic species) is carried out by detecting ions by the position sensitive type detector based on the time of flight from the emission of the individual ions from the apex of the sample caused by applying high voltage to arrival to the detector.

A coordinate in the depth direction is appropriately given to a two-dimensional map that indicates the arrival location of the ion by utilizing properties that the electric field evaporation occurs regularly in order from the apical surface of the sample and three-dimensional mapping (atomic structure in three dimension: atom map construction) is formed using an analytical software "IVAS". Thus, the three-dimensional atom map of the apex of the sample can be obtained. Using this three-dimensional atom map, the aggregate of atoms (cluster) is further analyzed using a Maximum Separation Method that is a method for defining atoms belonging to a precipitate and a cluster. In this analysis, the number of either of the Mg atoms or the Si atoms or both of Mg atoms and the Si atoms (10 or more atoms in total), the distance (space) between the Mg atom or the Si atom adjacent each other, and the number of Mg atom or Si atom having the specific narrow space (0.75 nm or less) described above are given as parameters.

The clusters satisfying the conditions in which either of Mg atoms or Si atoms or both of Mg atoms and Si atoms are contained by 10 or more atoms in total, and when any atom of the Mg atom or the Si atom included in the aggregate of atoms is determined to be a reference, the distance between the reference atom and any one of other adjacent atoms is 0.75 nm or less are defined to be the aggregate of atoms of the present invention.

On this basis, the number $N_{cluster}$ of Mg and Si atoms contained in all aggregates of atoms satisfying the conditions is determined. The number $N_{total}$ of all Mg and Si atoms detected with the detector and obtained in the solid solution and the aggregates of atoms, that is, measured with the 3DAP is determined. Then, the ratio of $N_{cluster}$ to $N_{total}$ is determined in accordance with the formula $(N_{cluster}/N_{total})\times 100$ and the average value of the ratios (average ratio) is controlled so as to be 10% or more and 30% or less.

(Detection Efficiency of Atoms by 3DAP)

At the present time, the limitation of the detection efficiency of atoms by this 3DAP is approximately 50% among the ionized atoms and the remaining atoms cannot be detected. When this detection efficiency of atoms with the 3DAP is significantly changed by future improvement and the like, the result of the average number density (clusters/$\mu m^3$) of each size of the clusters regulated by the present invention measured with the 3DAP may possibly change. Consequently, in order to assure the reproducibility in this measurement, it is preferable that the detection efficiency of atoms with the 3DAP be generally determined to be a constant of approximately 50%.

(Chemical Component Composition)

Subsequently, the chemical component composition of the 6000-series aluminum alloy sheet will be described below. For the 6000-series aluminum alloy sheet that is the target of the present invention, various properties such as excellent formability, BH response, strength, weldability, and corrosion resistance are required as a sheet for outer sheets of automobiles and the like described above. In order to satisfy such requirement, the composition of the aluminum alloy sheet is determined to contain Mg of 0.2% to 2.0% and Si of 0.3% to 2.0% in % by mass with the remainder comprising Al and inevitable impurities. Here, all % expressions of the contents of each element mean % by mass.

The 6000-series aluminum alloy sheet as the target of the present invention is preferably an excess-Si type 6000-series aluminum alloy sheet having excellent BH response and a mass ratio Si/Mg of Si and Mg of 1 or more. The 6000-series aluminum alloy sheet secures the formability by lowering the proof strength at the time of press forming and bending processing, and has excellent aging hardenability (BH response) in which the proof strength is improved by aging hardening by heating at the time of artificial aging treatment such as paint baking treatment and the like of panels after forming and thus required strength can be secured. Among them, the excess-Si type 6000-series aluminum alloy sheet has more excellent BH response in comparison with the 6000-series aluminum alloy sheet having a mass ratio Si/Mg of less than 1.

In the present invention, in order to improve the strength after BH, not only these main elements of Mg and Si but also one or two of Mn of 0.01% to 1.0% and Cu of 0.01% to 1.5%, which are equally effective as strengthening elements, are preferably contained. In the present invention, elements other than these Mg, Si, Cu, and Mn are basically impurities or elements that may be contained, and the content of each element level (allowable amount) is determined in accordance with AA, JIS Standards, or the like.

More specifically, also in the present invention, when not only high purity Al bullion but also the 6000-series alloy, other aluminum alloy scrap material, low purity Al bullion, and the like containing elements other than Mg, Si, Cu, and Mn in a large amount as additive elements (alloy elements) are used in a large amount as the melting raw material of an alloy from the viewpoint of resources recycling, other elements described below are inevitably mixed in a substantial amount. Refining itself that intentionally reduces these elements results in cost increase and thus it is necessary to allow these elements to be contained some extent. Even when a substantial amount of these elements may be contained, there is a range of content not impeding the purpose and effect of the present invention.

Consequently, in the present invention, other elements other than Mg, Si, Cu, and Mn are allowed to be contained as the inevitable impurities in a range of an upper limit amount or less in accordance with AA, JIS Standards, or the like individually regulated as described below. More specifically, the allowable amounts are as follows: Fe of 1.0% or less and more preferably 0.5% or less, Cr of 0.3% or less and more preferably 0.1% or less, Zr of 0.3% or less and more preferably 0.1% or less, V of 0.3% or less and more preferably 0.1% or less, Ti of 0.05% or less and more preferably 0.03% or less, Zn of 1.0% or less and more preferably 0.5% or less, and Ag of 0.2% or less and more preferably 0.1% or less.

The content range and significance or the allowable amounts of each element of Mg, Si, Cu, and Mn in the 6000-series aluminum alloy will be described below.

Si: 0.3% to 2.0%

Along with Mg, Si is an important element for forming the cluster regulated in the present invention. Si is an essential element for achieving strengthening of solid solution and aging hardenability by forming aging precipitates contributing to strength improvement at the time of the artificial aging treatment such as paint baking treatment and the like and securing the strength (proof strength) required as outer panels of automobiles. Further, Si is the most important element for providing the 6000-series aluminum alloy sheet of the present invention with various properties such as total elongation affecting the press formability. In order to achieve excellent aging hardenability in paint baking treatment after forming into the panel, a 6000-series aluminum alloy composition having Si/Mg of 1.0 or more in a mass ratio and excessively containing Si relative to Mg compared with the generally called excess-Si type aluminum alloy composition is preferable.

When the Si content is excessively low, the cluster regulated in the present invention cannot be formed in the regulated number density because the absolute amount of Si is insufficient and thus the paint baking hardenability extremely deteriorates. In addition, various properties such as the total elongation and the like required for each application cannot be achieved at the same time. On the other hand, when the Si content is excessively high, coarse metallic compounds and precipitates are formed and bending processability, total elongation, and the like extremely deteriorate. Further, the weldability is also extremely impeded. Consequently, Si is determined to be in a range of 0.3% to 2.0%. The range is preferably 0.6% to 1.2% and more preferably 0.8% to 1.0%.

Mg: 0.2% to 2.0%

Along with Si, Mg is also an important element for forming the cluster regulated in the present invention. Mg is an essential element for achieving strengthening of solid solution and aging hardenability by forming aging precipitates contributing to strength improvement along with Si at the time of the artificial aging treatment such as paint baking treatment and securing the proof strength required as panels When the Mg content is excessively low, the cluster regulated in the present invention cannot be formed in the regulated number density because the absolute amount of Mg is insufficient and thus the paint baking hardenability extremely deteriorates. Therefore, the proof strength required as panels cannot be secured. On the other hand, when the Mg content is excessively high, coarse metallic compounds and precipitates are formed and bending processability, total elongation, and the like extremely deteriorate. Consequently, Mg content is determined to be in a range of 0.2% to 2.0% and Si/Mg is determined to be 1.0 or more in a mass ratio. The range is preferably 0.4% to 1.0% and more preferably 0.5% to 0.8%.

Mn: 0.01% to 1.0% and Cu: 0.01% to 1.5%

Both Mn and Cu are elements that can improve both of the strength before the baking paint and after the baking paint by strengthening of solid solution. When the contents of Mn and Cu are excessively low, sufficient strengthening of solid solution cannot be obtained. On the other hand, when the contents of Mn and Cu are excessively high, coarse metallic compounds and precipitates are formed and bending processability, total elongation, and the like extremely deteriorate. Consequently, the content of Mn is determined to be an amount in a range of 0.01% to 1.0%, preferably 0.03% to 0.5%, and more preferably 0.05% to 0.3% and the content of Cu is determined to be an amount in a range of 0.01% to 1.5%, preferably 0.05% to 0.8%, and more preferably 0.08% to 0.3%.

Addition of these elements in combination provides actions in which the strength after BH becomes higher by combined effect of an aging precipitate formation promotion effect in the artificial aging treatment, a finer crystal grain formation effect of the sheet, a solid solution strengthening effect, and the like. Consequently, when the proof strength after BH is determined in a higher strength of 250 MPa in particular, these elements are positively added in combination. In this case, when each component is contained in the lower limit content or less, the addition effect is not achieved, whereas when each component is contained in more than the upper limit content, this addition causes the opposite effect of reduction in mechanical properties of the sheet such as generation of coarse intermetallic compounds and metallic compounds and deterioration in the rolling property and processability. This addition also causes reduction in required properties as a high strength panel material and a structural member such as deterioration in bending processability.

Elements other than the elements described above are basically impurity elements and are to have the content of each element level (allowable amount) in accordance with AA, JIS Standards, and the like.

(Production Method)

Subsequently, a method for producing the aluminum alloy sheet of the present invention will be described below. For the aluminum alloy sheet of the present invention, the production process itself is an ordinary method or a known method. The aluminum alloy sheet is produced by carrying out homogenizing heat treatment after casting an aluminum alloy ingot having the 6000-series component composition, subjecting to hot rolling and cold rolling to obtain a sheet having a predetermined sheet thickness, and further subjecting to refining treatment such as the solution hardening treatment.

However, in order to control the cluster of the present invention for improving the BH response during these production processes, solution heat treatment and reheating treatment should be more appropriately controlled as described below. In other processes, there are also preferable conditions for controlling the cluster within the regulated range of the present invention.

(Melting and Casting Cooling Rate)

First, in the melting and casting process, aluminum alloy molten metal that is molten and adjusted within the 6000-series component composition range is casted by appropriately selecting an ordinary melting and casting method such as a continuous casting method, and a semi-continuous casting method (DC casting method). Here, in order to control the cluster within the regulated range of the present invention, it is preferable that an average cooling rate at the time of casting be controlled as high (quick) as possible at 30° C./min or more from a liquidus temperature to a solidus temperature.

When such temperature (cooling rate) control in a high temperature region at the time of casting is not carried out, the cooling rate in the high temperature region inevitably becomes slow. When the average cooling rate in the high temperature range becomes slow, the amount of coarse metallic compounds formed in the temperature range in the high temperature region increases and the fluctuation of the size and the amount of the metallic compounds in the sheet thickness direction and the width direction of the ingot also increases. As a result, the possibility that the regulated cluster cannot be controlled in the range of the present invention increases.

(Homogenizing Heat Treatment)

Subsequently, the casted aluminum alloy ingot is subjected to homogenizing heat treatment before the hot rolling. The purpose of the homogenizing heat treatment (soaking treatment) is homogenization of the microstructure, that is, elimination of segregation within the crystal grains in the microstructure of the ingot. The treatment is not particularly limited as long as the conditions achieve this purpose and may be ordinary one time or one step treatment.

The homogenizing heat treatment temperature is appropriately selected from a range of 500° C. or more and less than the melting point, and the homogenizing time is appropriately selected from a range of 4 hours or more. When this homogenizing temperature is low, the segregation within the crystal grains cannot be sufficiently eliminated and the stretch flangeability and bending processability deteriorate because the segregation acts as a fracture origin. Even when hot rolling is immediately started thereafter or hot rolling is started after the ingot is cooled to an appropriate temperature and held, the cluster form regulated in the present invention can be controlled.

After carrying out the homogenizing heat treatment, the ingot can be cooled to room temperature in an average cooling rate of 20° C./h to 100° C./hr between 300° C. and 500° C. and then can be reheated to 350° C. to 450° C. in an average heating rate of 20° C./hr to 100° C./hr. The hot rolling can be started at this temperature range.

When the conditions of the average cooling rate after the homogenizing heat treatment and the reheating rate thereafter deviate from conditions described above, the possibility of formation of coarse Mg—Si compounds increases.

(Hot Rolling)

Hot rolling is constituted of a rough rolling process of the ingot (slab) and a finish rolling process depending on the thickness of the sheet to be rolled. In these rough rolling process and finish rolling process, rolling mills such as a reverse type rolling mills or tandem type rolling mill are appropriately used.

At this time, the hot rolling itself is difficult to be carried out due to burning under conditions that the hot rolling (rough rolling) start temperature exceeds the solidus temperature. On the other hand, when the hot rolling start temperature is less than 350° C., hot rolling itself is difficult to be carried out because the load at the time of the hot rolling becomes excessively high. Consequently, the hot rolling start temperature is determined to be in a range of 350° C. to the solidus temperature and more preferably 400° C. to the solidus temperature.

(Annealing of Hot Rolled Sheet)

Annealing (rough annealing) of the hot rolled sheet before cold rolling is not necessarily required. The annealing, however, may be carried out in order to further improve the properties such as the formability and the like by forming finer crystal grains and optimizing aggregated microstructures.

(Cold Rolling)

In the cold rolling, the hot rolled sheet is rolled to produce a cold rolled sheet (including a coil) having a desired final sheet thickness. However, in order to form finer crystal grains, a cold rolling ratio is preferably 60% or more and intermediate annealing may be carried out between cold rolling passes in a similar purpose to the purpose of the rough annealing described above.

(Solution Heat Treatment and Quenching Treatment)

After the cold rolling, solution heat and quenching treatment is carried out. The solution heat and quenching treatment can be carried out by heating and cooling by an ordinary continuous heat treatment line and is not particularly limited. The solution hardening, however, is preferably carried out by heating to a solution heat treatment temperature of 520° C. or more and the melting temperature or less at the heating rate of 5° C./s or more and being held for 0 seconds to 10 seconds because it is preferable that the sufficient amount of the solid solution of each element be secured and the crystal grain size is finer as described above.

From the viewpoint of suppressing formation of coarse grain boundary compounds that deteriorate the formability and hem processability, the average cooling rate from the solution heating temperature to 200° C. is preferably determined to be 3° C./s or more. When the cooling rate during the solution heat treatment is low, coarse $Mg_2Si$ and elemental Si are generated during cooling, and thus the formability deteriorates. In addition, the amount of solid solution after the solution heat treatment decreases and thus the BH response deteriorates. In order to secure this cooling rate, air cooling such as a fan, water cooling means such as mist, spray, and immersion, and conditions are selectively used respectively in the quenching treatment.

(Reheating Treatment)

The reheating treatment is carried out after the solution heat and quenching treatment. This reheating treatment is carried out in two stages. In the first stage, the reheating treatment is carried out at the attainable temperature (heating temperature) in a temperature range of 100° C. to 250° C. for a holding time of several seconds to several minutes. The cooling after the reheating treatment in the first stage may be left to stand to cool or may be forced rapid cooling with a cooling means at the time of the solution heat and quenching treatment for effective production. Subsequently, in the second stage, the reheating treatment is carried out at the attainable temperature (heating temperature) in a temperature range of 70° C. to 130° C. for a holding time of 3 hours to 24 hours.

When the conditions of the reheating treatment deviates from such reheating treatment conditions, it is difficult to determine that an average content of the sum of Mg and Si contained in the aggregate of atoms is 10% or more and 30% or less of the content of the sum of Mg and Si contained in the aluminum alloy sheet. For example, when the attainable temperature in the first stage is less than 100° C. or the attainable temperature in the second stage is less than 70° C., Mg—Si clusters promoting the BH response are insufficiently generated. On the other hand, when the attainable temperature of the reheating is excessively high, an intermetallic compound phase such as β" phases or β' phases which is different from the cluster is partially formed. This results in the number density of the cluster being less than the regulated number density and thus the BH response becomes excessively low. In addition, β" phases or β' phases tend to cause deteriorated formability.

The cooling after the second stage of the reheating treatment to room temperature may be left to stand to cool or may be forced rapid cooling with a cooling means at the time of the quenching for effective production. In other word, the clusters having equal or similar size regulated in the present invention are completely formed by the temperature holding treatment, and thus the forced rapid cooling in conventional reheating treatment and complicated control of average cooling rate over several stages are unnecessary.

Hereinafter, the present invention will be described more specifically with reference to Example. The present invention, however, is not limited by Example described below and can be also implemented with appropriate modifications within the scope suitable for the purposes described above and below. Any of the modifications is included within the technical range of the present invention.

Examples

Subsequently, examples of the present invention will be described. 6000-series aluminum alloy sheets having different compositions and cluster conditions regulated in the present invention were separately prepared by the two-stage reheating treatment after completion of solution heat treatment and quenching treatment. The microstructure (cluster) and the strength after 100-day holding at room temperature of each example, the BH response (paint baking hardenability) after 100-day holding at room temperature of each example, and bending processability were evaluated respectively.

In the description of the contents in Table 1 in which compositions of 6000-series aluminum alloy sheets of each example are listed, the description where the figure in each element is blank means that the content is equal to or less than the detection limit and these elements are not contained, that is, equal to 0%.

The specific production conditions of the aluminum alloy sheets are as follows. The aluminum alloy ingots of each composition listed in Table 1 were commonly molten by a DC casting method. At this time, in each example in common, the average cooling rate during the casting was determined to be 50° C./min from the liquidus temperature to the solidus temperature. Subsequently, in each example in common, the ingots were subjected to soaking treatment under conditions of 540° C. for 4 hours and thereafter hot rough rolling was started. In each example in common, hot rolling was carried out in subsequent finish rolling to the thickness of 3.5 mm to obtain the hot rolled sheet. In each example in common, for the aluminum alloy sheets after hot rolling, a rough annealing of 500° C. for 1 minute was carried out thereafter without intermediate annealing in the middle of cold rolling, and in each example in common, the sheets are cold rolled in a process ratio of 70% to obtain the cold rolled sheets having a thickness of 1.0 mm Further, in each of examples in common, each of the cold rolled sheets was subjected to solution heat treatment in a nitrate furnace at 560° C. After reaching the target temperature, the sheet was maintained at the target temperature for 10 seconds, and then the quenching treatment was carried out by water cooling. After completion of this quenching treatment, the sheet was subjected to first stage pre-aging treatment at 100° C. to 250° C. under each condition listed in Table 2 and then the sheet was water cooled to room temperature. Thereafter, the sheet was subjected to second stage pre-aging treatment at 70° C. to 130° C. and then the sheet was water cooled to room temperature. In the example, each cooling is carried out by water cooling after the reheating treatment in the first stage and the second stage. However, similar microstructures can be obtained when the cooling is carried out by being left to stand to cool.

Sample sheets (blank) were cut out from each sheet left to stand at room temperature for 100 days after the refining treatment and the microstructure and the strength (AS proof strength) of each sample sheet were measured. The microstructure observation using the 3DAP described above was carried out only for the samples that were left to stand for 100 days after the refining treatment. These results are listed in Table 3.

(Cluster)

First, microstructures in a cross sectional surface in a sheet thickness direction in the center part along the sheet thickness of the sample sheets after the 100-day natural aging at room temperature were analyzed by the 3DAP method and the number density of the cluster ($\times 10^{24}$ clusters/$m^3$) regulated in the present invention was determined. The sum $N_{total}$ of the number of atoms of all Mg atoms and Si atoms measured by this 3DAP method is also determined. Further, the sum $N_{cluster}$ of the number of atoms of all Mg atoms and Si atoms contained in the cluster (aggregate of atoms that satisfy the conditions that either of Mg atoms or Si atoms or both of Mg atoms and Si atoms are contained by 10 or more atoms in total, when any atom of the Mg atoms or the Si atoms contained in the clusters determined to be a reference, a distance between the reference atom and any one of other adjacent atoms is 0.75 nm or less) regulated in the present invention analyzed by this 3DAP method was determined. Then, the ratio of $N_{cluster}$ to $N_{total}$ was determined in accordance with the formula $(N_{cluster}/N_{total})\times 100$. These results are listed in Table 3. In Table 3, among the cluster conditions regulated in the present invention, that either of Mg atoms or Si atoms or both of Mg atoms and Si atoms are contained by 10 or more atoms in total is simply described as "10 or more atoms of Mg and/or Si atoms" in a simplified manner. In addition, that when any atom of the Mg atoms or the Si atoms contained in the clusters is determined to be a reference, a distance between the reference atom and any one of other adjacent atoms is 0.75 nm or less is simply described as "distance of 0.75 nm or less" in a simplified manner.

For the measurement by the 3DAP method, a needle shape sample having an apical radius of 50 nm was prepared by cutting three square rods having a length of 30 mm, a width of 1 mm, and a thickness of 1 mm from the sample sheet having a thickness of 1 mm spaced apart by 1 mm in a width direction with a precision cutting machine, and thereafter finely processing the square rods by electropolishing. Therefore, the measurement position is located near the center part in the sheet thickness direction. This aluminum alloy sheet sample whose apex is formed in a needle shape is measured by the 3DAP using "LEAP 3000" manufactured by Imago Scientific Instruments Corporation. Each ratio of $N_{cluster}$ to $N_{total}$ of the three square rods were determined and the obtained ratios were averaged. Consequently, the value of the ratio of $N_{cluster}$ to $N_{total}$ in the example is an averaged value of three measurement times. The measured volume measured by the 3DAP method is about $1.0\times 10^{-22}$ to $10^{-21}$ $mm^3$.

(Baking Paint Hardenability)

As the mechanical properties of each sample sheet after the 100-day natural aging at room temperature, 0.2% proof strength (As proof strength) and 0.2% proof strength (after BH proof strength) after artificial aging hardening treatment (after BH) of 185° C. for 20 minutes were determined by tensile test carried out in the same manner. The BH response of each sample sheet was determined from the difference (increased amount of proof strength) of both 0.2% proof strengths.

As the tensile test, No. 5 test specimens (25 mm×50 mm GL×sheet thickness) of JIS Z 2201 were collected from each of the sample sheets and the tensile test was carried out at room temperature. The tensile direction of the test specimen at the time of the tensile test was determined to be the direction orthogonal to the rolling direction. The tensile rate was determined to be 5 mm/min to the 0.2% proof strength and then 20 mm/min from the 0.2% proof strength. The number of the measurement times of the mechanical properties was determined to be 5 times and each of the mechanical property was calculated in the average value. For the test specimen for the proof strength measurement after the BH, the BH treatment was carried out after a pre-strain of 2%, which simulates the press forming of the sheet, was applied by the tensile tester.

(Bending Processability)

The bending processability was evaluated for each of the sample sheets after being left to stand at room temperature for 100 days after the refining treatment. The test was carried out by preparing a test specimen having a width of 30 mm and a length of 35 mm, in which a long axis was determined to be the rolling direction, and applying 2000 kgf load in accordance with JIS Z 2248 to carry out 90° V shape bending with a bending radius of 2.0 mm.

The surface state such as the rough surface, occurrence of a minute crack and a large crack of the bent part (edge bent part) was visually observed and was visually evaluated by the following criteria.

9: without cracks and without rough surface, 8; without cracks and with slight rough surface, 7; without cracks and with rough surface, 6; with slight minute cracks, 5; with minute cracks, 4; with minute cracks in entire surface, 3; with large crack, 2; with large crack and being on the verge of breakage, and 1; breakage Each inventive example is listed in alloy number of 0 to 9 in Table 1, and in number of 0, 1, 7, 13, and 19 to 24. As listed in Table 1 and Table 2, each inventive example is prepared and subjected to the refining treatment within the component composition range of the present invention and within the preferable condition range. Therefore, as listed in Table 3, each inventive example satisfies the cluster conditions regulated in the present invention. In other words, the average ratio of Mg and/or Si atoms contained in the aggregate of atoms calculated by the formula $N_{cluster}/N_{total}\lambda$ 100 is 10% or more and 30% or less. As a result, as listed in Table 3, each inventive example has the excellent BH response and the excellent bending processability even after the natural aging at room temperature for a long period of time such as 100 days. In other words, it is found that when the strength before baking paint is intentionally improved, the strength after BH can be further improved and BH response can be further improved.

Comparative examples 2 to 6, 8 to 12, and 14 to 18 in Table 2 are prepared using inventive alloy examples 1, 2, and 3. However, as listed in Table 2, each comparative example deviates from preferable conditions of two-stage reheating treatment after completion of the solution heat treatment and the quenching treatment.

In comparative examples 2, 8, and 14, the reheating treatment is carried out only in one stage of the second stage.

In comparative examples 3, 9, and 15, the reheating treatment temperature in the first stage is excessively low.

In comparative examples 4, 10, and 16, the reheating treatment temperature in the first stage is excessively high.

In comparative examples 5, 11, and 17, the reheating treatment temperature in the second stage is excessively high.

In comparative examples 6, 12, and 18, the reheating treatment temperature in the second stage is excessively low.

Therefore, as listed in Table 3, the average ratios of Mg and/or Si atoms contained in the aggregate of atoms calculated by the formula $N_{cluster}/N_{total}\times100$ of these each comparative example deviates from 10% or more and 30% or less. As a result, these comparative examples have inferior BH response and strength after the BH to inventive examples 1, 2, and 3 that have the same respective alloy compositions.

Comparative examples 25 to 32 in Table 2 are prepared in a preferable range including the refining treatment. However, these comparative examples use alloys of alloy numbers 10 to 17 in Table 1 and each content of Mg or Si that are essential elements deviates from the range of the present invention or some of these comparative examples contains excessive amounts of Mn, Cu, and impurity elements. As a result, as listed in Table 3, each of these comparative examples has inferior BH response and hem processability to each inventive example.

Comparative example 25 is alloy 10 in Table 1 that contains excessively low Si.

Comparative example 26 is alloy 11 in Table 1 that contains excessively high Si.

Comparative example 27 is alloy 12 in Table 1 that contains excessively high Fe.

Comparative example 28 is alloy 13 in Table 1 that contains excessively high Mn.

Comparative example 29 is alloy 14 in Table 1 that contains excessively high Cu.

Comparative example 30 is alloy 15 in Table 1 that contains excessively high Cr.

Comparative example 31 is alloy 16 in Table 1 that contains excessively high Ti and Zn.

Comparative example 32 is alloy 17 in Table 1 that contains excessively high Zr and V.

From the results of the example described above, it is supported that conditions for the cluster regulated in the present invention are required to be satisfied for achieving higher BH response and proof strength after BH even when the strength before the baking paint is high. It is also supported that, in order to secure such cluster conditions and BH response, each requirement for the component composition or preferable production condition in the present invention have critical importance and effect.

TABLE 1

| | | Chemical composition of Al—Mg—Si alloy sheet (% by mass, remainder Al) | | | | | | | | | | |
|---|---|---|---|---|---|---|---|---|---|---|---|---|
| Classification | Alloy number | Mg | Si | Fe | Mn | Cu | Cr | Zr | V | Ti | Zn | Ag |
| Inventive | 0 | 0.60 | 1.10 | | | | | | | | | |
| Example | 1 | 0.90 | 1.20 | 0.20 | | | | | | | | |
| | 2 | 0.80 | 1.00 | 0.20 | 0.1 | | | | | | | |
| | 3 | 0.80 | 1.20 | 0.20 | | 0.2 | | | | | | |
| | 4 | 0.70 | 1.20 | 0.20 | 0.4 | | | | | 0.1 | | |
| | 5 | 0.65 | 1.10 | 0.20 | | 0.7 | | | | | | |
| | 6 | 0.60 | 0.90 | 0.20 | 0.07 | 0.2 | | | | | | |
| | 7 | 0.60 | 1.10 | 0.20 | | | | 0.05 | | | 0.15 | |
| | 8 | 0.40 | 1.15 | 0.20 | 0.05 | | 0.05 | | 0.1 | | | |

TABLE 1-continued

| Classification | Alloy number | Chemical composition of Al—Mg—Si alloy sheet (% by mass, remainder Al) | | | | | | | | | | |
|---|---|---|---|---|---|---|---|---|---|---|---|---|
| | | Mg | Si | Fe | Mn | Cu | Cr | Zr | V | Ti | Zn | Ag |
| | 9 | 1.00 | 0.80 | 0.20 | | 0.1 | | | | | | 0.1 |
| Comparative Example | 10 | 0.80 | 0.20 | 0.20 | | | | | | | | |
| | 11 | 0.40 | 2.10 | 0.20 | | | | | | | | |
| | 12 | 0.50 | 0.90 | 1.30 | | | | | | | | |
| | 13 | 0.60 | 1.10 | 0.20 | 1.1 | | | | | | | |
| | 14 | 0.60 | 1.10 | 0.20 | | 1.8 | | | | | | |
| | 15 | 0.50 | 0.90 | 0.20 | | | 0.4 | | | | | |
| | 16 | 0.40 | 0.90 | 0.20 | | | | | | 0.08 | 1.2 | |
| | 17 | 0.60 | 1.00 | 0.20 | | | | 0.4 | 0.4 | | | |

* Column where the content of each element is blank means the content is less than the detection limit

TABLE 2

| Classification | Number | Alloy number in Table 1 | First stage of reheating treatment | | Second stage of reheating treatment | |
|---|---|---|---|---|---|---|
| | | | Temperature ° C. | Holding Minute | Temperature ° C. | Holding h |
| Inventive Example | 0 | 0 | 200 | 2 | 100 | 5 |
| Inventive Example | 1 | 1 | 200 | 2 | 100 | 5 |
| Comparative Example | 2 | 1 | — | — | 90 | 5 |
| Comparative Example | 3 | 1 | 80 | 2 | 100 | 5 |
| Comparative Example | 4 | 1 | 280 | 2 | 80 | 5 |
| Comparative Example | 5 | 1 | 200 | 2 | 150 | 3 |
| Comparative Example | 6 | 1 | 200 | 2 | 70 | 5 |
| Inventive Example | 7 | 2 | 200 | 2 | 100 | 5 |
| Comparative Example | 8 | 1 | — | — | 90 | 5 |
| Comparative Example | 9 | 2 | 80 | 2 | 100 | 5 |
| Comparative Example | 10 | 2 | 280 | 2 | 80 | 5 |
| Comparative Example | 11 | 2 | 200 | 2 | 150 | 3 |
| Comparative Example | 12 | 2 | 200 | 2 | 70 | 5 |
| Inventive Example | 13 | 3 | 200 | 2 | 100 | 5 |
| Comparative Example | 14 | 1 | — | — | 90 | 5 |
| Comparative Example | 15 | 3 | 80 | 2 | 100 | 5 |
| Comparative Example | 16 | 3 | 280 | 2 | 80 | 5 |
| Comparative Example | 17 | 3 | 200 | 2 | 150 | 3 |
| Comparative Example | 18 | 3 | 200 | 2 | 70 | 5 |
| Inventive Example | 19 | 4 | 150 | 5 | 100 | 5 |
| Inventive Example | 20 | 5 | 170 | 2 | 110 | 5 |
| Inventive Example | 21 | 6 | 180 | 5 | 100 | 5 |
| Inventive Example | 22 | 7 | 200 | 2 | 80 | 3 |
| Inventive Example | 23 | 8 | 120 | 2 | 100 | 3 |
| Inventive Example | 24 | 9 | 220 | 0.5 | 90 | 3 |
| Comparative Example | 25 | 10 | 200 | 2 | 100 | 5 |
| Comparative Example | 26 | 11 | 200 | 2 | 100 | 5 |
| Comparative Example | 27 | 12 | 200 | 2 | 100 | 5 |
| Comparative Example | 28 | 13 | 200 | 2 | 100 | 5 |
| Comparative Example | 29 | 14 | 200 | 2 | 100 | 5 |
| Comparative Example | 30 | 15 | 200 | 2 | 100 | 5 |
| Comparative Example | 31 | 16 | 200 | 2 | 100 | 5 |
| Comparative Example | 32 | 17 | 200 | 2 | 100 | 5 |

TABLE 3

| Classification | Number | Alloy number in Table 1 | Microstructure and properties of aluminum alloy sheet after 100-day holding at room temperature Regulated cluster (10 or more atoms of Mg and/or Si atoms, a distance of 0.75 nm or less) Average density × $10^{23}$ clusters/$m^3$ | Ncluster/Ntotal × 100 | Properties of aluminum alloy sheet after 100-day holding at room temperature As proof strength 0.2% proof strength MPa | 0.2% Proof strength after BH MPa | Increased amount in proof strength of BH response MPa | Bending processability 90° V shape bending |
|---|---|---|---|---|---|---|---|---|
| Inventive Example | 0 | 0 | 15 | 19.3 | 143 | 244 | 101 | 9 |
| Inventive Example | 1 | 1 | 21 | 18.9 | 158 | 271 | 113 | 9 |
| Comparative Example | 2 | 1 | 18 | 8.3 | 142 | 220 | 78 | 9 |
| Comparative Example | 3 | 1 | 19 | 9.3 | 147 | 230 | 83 | 9 |
| Comparative Example | 4 | 1 | 8 | 8.8 | 193 | 240 | 47 | 6 |
| Comparative Example | 5 | 1 | 7 | 7.9 | 183 | 232 | 49 | 6 |
| Comparative Example | 6 | 1 | 19 | 7.3 | 145 | 234 | 89 | 9 |
| Inventive Example | 7 | 2 | 23 | 18.7 | 166 | 278 | 112 | 8 |
| Comparative Example | 8 | 2 | 18 | 9.1 | 148 | 228 | 80 | 9 |
| Comparative Example | 9 | 2 | 16 | 8.8 | 152 | 236 | 84 | 9 |
| Comparative Example | 10 | 2 | 7 | 7.9 | 195 | 240 | 45 | 4 |
| Comparative Example | 11 | 2 | 7 | 9.4 | 184 | 234 | 50 | 4 |
| Comparative Example | 12 | 2 | 20 | 7.7 | 148 | 235 | 87 | 9 |
| Inventive Example | 13 | 3 | 22 | 17.5 | 172 | 285 | 113 | 7 |
| Comparative Example | 14 | 3 | 19 | 8.2 | 153 | 231 | 78 | 9 |
| Comparative Example | 15 | 3 | 15 | 8.9 | 157 | 238 | 81 | 9 |
| Comparative Example | 16 | 3 | 9 | 7.9 | 198 | 237 | 39 | 4 |
| Comparative Example | 17 | 3 | 8 | 9.1 | 186 | 232 | 46 | 4 |
| Comparative Example | 18 | 3 | 14 | 7.5 | 153 | 241 | 88 | 9 |
| Inventive Example | 19 | 4 | 14 | 16.8 | 179 | 285 | 106 | 6 |
| Inventive Example | 20 | 5 | 16 | 17.4 | 189 | 305 | 116 | 6 |
| Inventive Example | 21 | 6 | 17 | 20.3 | 184 | 297 | 113 | 6 |
| Inventive Example | 22 | 7 | 15 | 19.1 | 152 | 251 | 99 | 9 |
| Inventive Example | 23 | 8 | 19 | 17.8 | 151 | 252 | 101 | 9 |
| Inventive Example | 24 | 9 | 14 | 14.2 | 163 | 259 | 96 | 9 |
| Comparative Example | 25 | 10 | 5 | 5.1 | 125 | 177 | 52 | 9 |
| Comparative Example | 26 | 11 | 11 | 4.5 | 133 | 216 | 83 | 9 |
| Comparative Example | 27 | 12 | 9 | 6.8 | 153 | 233 | 80 | 7 |
| Comparative Example | 28 | 13 | 12 | 6.6 | 174 | 247 | 73 | 5 |
| Comparative Example | 29 | 14 | 16 | 15.5 | 202 | 294 | 92 | 5 |
| Comparative Example | 30 | 15 | 12 | 6.3 | 163 | 226 | 63 | 6 |
| Comparative Example | 31 | 16 | 14 | 14.6 | 158 | 239 | 81 | 6 |
| Comparative Example | 32 | 17 | 12 | 12.7 | 166 | 248 | 82 | 6 |

Although the present invention is described in detail with reference to the particular embodiment, it is appreciated for those skilled in the art that various alterations and modifications of the embodiment can be made without departing from the spirit and the scope of the present invention.

This application is based on Japanese Unexamined Patent Application filed on Feb. 13, 2013 (Japanese Unexamined Patent Application Publication No. 2013-025619) and the contents of which are incorporated herein by reference.

INDUSTRIAL APPLICABILITY

According to the present invention, a 6000-series aluminum alloy sheet that can achieve higher BH response even when the natural aging at room temperature, which increases the strength before the baking paint, is carried out. As a result, the 6000-series aluminum alloy sheet can be suitably used as thin sheets for panel materials for automobiles; pillars such as center pillars and arms such as side arms, which are skeletal members or structural members; or reinforcing members such as bumper reinforcements and door beams; and skeletal members or structural members for applications other than automotive use.

The invention claimed is:

1. An Al—Mg—Si alloy sheet, comprising:

Mg in an amount of 0.2 mass % to 2.0 mass %,

Si in an amount of 0.3 mass % to 2.0 mass % and

Al, wherein a ratio of $N_{cluster}$ to $N_{total}$ is 10% or more and 30% or less, where $N_{total}$ is a sum of a number of all Mg atoms and Si atoms measured by a three-dimensional atom probe field ion microscope, and $N_{cluster}$ is a sum of a number of all Mg atoms and Si atoms comprised in all aggregates of atoms that satisfy the following conditions: (i) the aggregate of atoms measured by the three-dimensional atom probe field ion microscope comprises either the Mg atoms or the Si atoms or both the Mg atoms and the Si atoms by 10 or more atoms in total; and, (ii) when any atom of the Mg atoms or the Si atoms comprised in the aggregate of atoms is determined to be a reference atom, a distance between the reference atom and any one of other adjacent atoms is 0.75 nm or less.

2. The Al—Mg—Si alloy sheet according to claim 1, further comprising at least one of Mn in an amount of 0.01 mass % to 1.0 mass % and Cu in an amount of 0.01 mass % to 1.5 mass %.

3. The Al—Mg—Si alloy sheet according to claim 1, further comprising Mn in an amount of 0.01 mass % to 1.0 mass % and Cu in an amount of 0.01 mass % to 1.5 mass %.

4. The Al—Mg—Si alloy sheet according to claim 1, comprising Si in an amount of 0.6 mass % to 1.2 mass %.

5. The Al—Mg—Si alloy sheet according to claim 1, comprising Si in an amount of 0.8 mass % to 1.0 mass %.

6. The Al—Mg—Si alloy sheet according to claim 1, comprising Mg in an amount of 0.4 mass % to 1.0 mass %.

7. The Al—Mg—Si alloy sheet according to claim 1, comprising Mg in an amount of 0.5 mass % to 0.8 mass %.

8. The Al—Mg—Si alloy sheet according to claim 1, Si in an amount of 0.6 mass % to 1.2 mass % and Mg in an amount of 0.4 mass % to 1.0 mass %.

9. The Al—Mg—Si alloy sheet according to claim 1, comprising Si in an amount of 0.8 mass % to 1.0 mass % and Mg in an amount of 0.5 mass % to 0.8 mass %.

10. The Al—Mg—Si alloy sheet according to claim 3, comprising Si in an amount of 0.8 mass % to 1.0 mass % and Mg in an amount of 0.5 mass % to 0.8 mass %.

* * * * *